US006709552B2

(12) United States Patent
Sakuma et al.

(10) Patent No.: US 6,709,552 B2
(45) Date of Patent: Mar. 23, 2004

(54) PAPERMAKING BELT

(75) Inventors: Norio Sakuma, Tanashi (JP); Harushige Ikeda, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 0 days.

(21) Appl. No.: 09/880,299

(22) Filed: Jun. 13, 2001

(65) Prior Publication Data

US 2002/0028317 A1 Mar. 7, 2002

Related U.S. Application Data

(62) Division of application No. 09/366,628, filed on Aug. 3, 1999, now abandoned.

(30) Foreign Application Priority Data

Aug. 6, 1998 (JP) ..... 10-236579
May 10, 1999 (JP) ..... 11-128503

(51) Int. Cl.[7] ..... D21F 3/00

(52) U.S. Cl. ..... 162/358.4; 162/358.3; 162/358.1; 162/901; 428/357; 428/359; 428/361; 428/60; 427/260; 427/268

(58) Field of Search ..... 162/358.4, 358.3, 162/358.1, 901; 428/357, 359, 361, 364, 60; 474/260–268

(56) References Cited

U.S. PATENT DOCUMENTS 4,330,023 A * 5/1982 Cronin ..... 162/358
4,518,376 A * 5/1985 Mashimo et al. ..... 474/261
4,737,138 A * 4/1988 Komai et al. ..... 474/266
5,208,087 A * 5/1993 Stigberg ..... 428/60
5,658,655 A 8/1997 Stanhope
5,753,369 A 5/1998 Kawashima et al.
5,954,606 A * 9/1999 Mishima et al. ..... 474/267

FOREIGN PATENT DOCUMENTS

| | | |
|---|---|---|
| JP | 15398 | 4/1988 |
| JP | 38477 | 7/1988 |
| JP | 64639 | 10/1991 |
| JP | 82988 | 3/1992 |
| JP | 311591 | 11/1993 |

* cited by examiner

*Primary Examiner*—Steven P. Griffin
*Assistant Examiner*—Mark Halpern
(74) *Attorney, Agent, or Firm*—Howson & Howson

(57) ABSTRACT

In a one-surface coated papermaking belt composed of a base layer and a thick resin layer, or a covered, one-surface coated papermaking belt composed of thin and thick resin layers on opposite sides of a base layer, curling of the edges of the belt due to the shrinkage of the thick resin layer is reduced by forming the opposite side edge parts of the thick resin layer thinner than the middle part. The reduction in curling results in improved oil removal especially in a shoe-press belt. It also stabilizes turning of the belt and facilitates belt installation.

8 Claims, 6 Drawing Sheets

PAPERMAKING BELT

CROSS REFERENCE TO RELATED APPLICATION

This is a division of pending U.S. patent application Ser. No. 09/366,628, filed Aug. 3, 1999 now abandoned.

FIELD OF THE INVENTION

This invention relates to papermaking, and specifically to a papermaking belt, such as a shoe press belt to be used on an open type shoe press paper machine, or a sheet transfer belt.

BACKGROUND OF THE INVENTION

In an open type shoe press, a "shoe press belt" passes around a plurality of rolls and runs through a nip between a press roll and a shoe. A wet paper sheet, sandwiched between felt belts, moves through the nip with the shoe press belt, and is compressed between the press roll and the shoe to squeeze out water.

For high speed operation of a paper machine, a transfer belt is used. A wet paper sheet produced on a forming wire belt is separated from the forming wire belt by a felt pickup belt wound around a pickup roll provided with suction glands. The wet paper sheet, adhering to the outer surface of the felt pickup belt, is conveyed to a press nip formed by upper and lower press rolls, between the felt pickup belt and a sheet transfer belt. When the wet paper sheet is compressed in the press nip, water is transferred from the wet paper sheet to the felt pickup belt. After passing through the press nip, the felt pickup belt is separated from the wet paper sheet.

The wet paper sheet is then conveyed further by the sheet transfer belt to a second press nip. The sheet transfer belt has a flat, smooth, water-impermeable surface, preventing rewetting of the paper sheet, which would occurs if a felt belt were used.

The wet paper sheet is squeezed again at the second press nip between the sheet transfer belt and another felt press belt. This nip may be formed either by two press rolls or by a press roll and a shoe in combination with a press belt. The sheet transfer belt is separated from a wet paper sheet by a guide roll. The wet paper sheet is carried by the sheet transfer belt or by a felt belt, which prevent the wet paper sheet from breaking and make it possible to form the wet paper sheet at a high speed.

In the open type shoe press paper machine, a lubricating oil is sprayed by an oil spraying device onto the inner surface of the shoe press belt at a position immediately ahead of the shoe to reduce friction between the inner surface of the shoe press belt and the shoe. The lubricating oil is scraped off the belt by a scraper and an oil removing brush, both disposed beyond the shoe.

Most papermaking belts heretofore used on open type shoe press paper machines have a base layer and a resin layer coating the surface on the shoe-facing side of the belt. A belt of this type will be referred to as "one-surface coated belt". Belts recently introduced into the market have a base layer, a resin layer formed on the inner surface of the base layer, and a thin resin layer formed on the outer surface, with a view to enhancing abrasion resistance and draining performance. A belt of this type will be referred to as "outside-covered one-surface coated belt". Papermaking belts for achieving closed draw recently introduced into the market have a construction opposite to that of the outside-covered one-surface coated belt. A belt of this type will be referred to as "inside-covered, one-surface coated belt".

The edges of the one-surfaced coated belt, the outside-covered, one-surface coated belt and the inside-covered, one-surface coated belt have a tendency to curl toward the resin layer side while the belt is in use. The transfer belt also has a tendency to curl toward the resin layer side. This tendency to curl is caused by the greater shrinkage of the resin layer relative to the shrinkage of the adjoining base layer. The shrinkage of a resin layer formed by a hot melt coating process is even greater than that of a resin layer formed by a liquid resin application.

Excessive curling of the belts causes gaps to form between the oil scraper and the inner surface of the belt, reducing the effectiveness of the scraper in removing lubricating oil from the belt. If the lubricating oil is not scraped off satisfactorily, the oil remaining on the belt is transferred to a roll and scattered as an oil mist. Consequently, the consumption of the lubricating oil increases, costs increase, the environment around the paper machine is soiled by lubricating oil and waste water will also contain lubricating oil.

Further problems caused by curling of the belt are that the contact of the side edges of the belt with guide palms becomes unstable, and the side edge of the belt tend to catch on ends of the rolls in the process of installing the belt onto the rolls.

One-surface coated belts are disclosed in Japanese Patent Publications Nos. 38477/1988, 15398/1988 and 64639/1991 and Japanese Unexamined Patent Publication Nos. 82988/1992 and 311591/1993, but no mention is made of the curling of the side edges of the belts.

The general object of this invention is to solve one or more of the aforementioned problems. It is also an object of the invention to provide a papermaking belt for use as an open type shoe press belt of a one-surface coated type or an outside covered, one-surfaced coated type or a sheet transfer belt of a one-surface coated type or an inside-coated, one-surfaced coated type, comprising a base layer and a resin layer, and capable of reducing or preventing the curling of side edges thereof due to the difference in thermal shrinkage between the base layer and the resin layer.

With the foregoing objects in view, according to a first aspect of the invention, a papermaking belt of a one-surfaced coated type for use as an open type shoe press belt or a sheet transfer belt comprises a base layer and a resin layer formed on the outer or the inner surface of the base layer when the papermaking belt is mounted on a paper machine, and the resin layer is formed so that the thickness of opposite side edge parts thereof is smaller than that of a middle part thereof to suppress the differential shrinkage effect intrinsic to one-surface coated belts.

According to a second aspect of the invention, a papermaking belt of an outside-covered one-surface coated type or an inside-covered one-surface coated type comprises a base layer, a thin resin layer formed on one of the surfaces of the base layer when the papermaking belt is mounted on a paper machine, and a thick resin layer formed on the other surface of the base layer. The thickness of the thick resin layer decreases widthwise from a middle part of the thick resin layer toward the side edges of the same to suppress the differential contraction effect which is also intrinsic to outside-covered one-surface coated belts and inside-covered one-surface coated belts.

DETAILED DESCRIPTION

Figure 4:
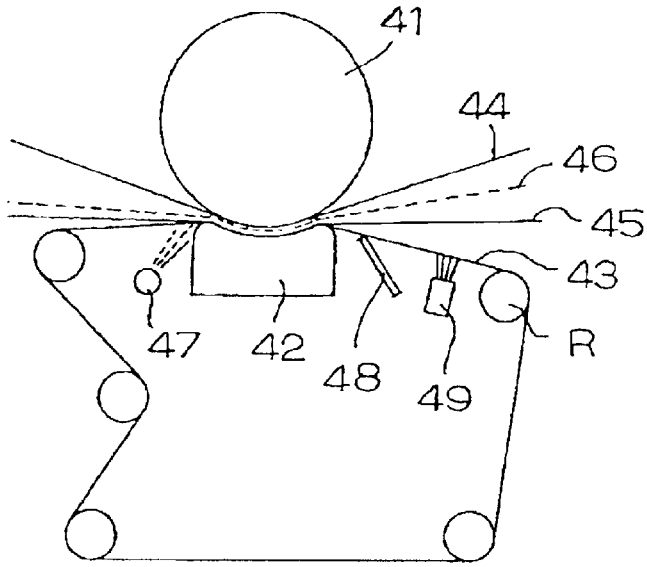
FIG. 4 is a diagrammatic view of an open type shoe press paper machine.

Referring to FIG. 4, which illustrates a conventional open type shoe press paper machine, a shoe press belt 43 is wound around a plurality of rolls so as to run past a nip between a top (press) roll 41 and a shoe 42. A wet paper sheet 46, sandwiched between a top felt belt 44 and a bottom felt belt 45, is compressed between the top roll 41 and the shoe 42, and water is thereby squeezed out of the wet paper sheet.

Figure 5:
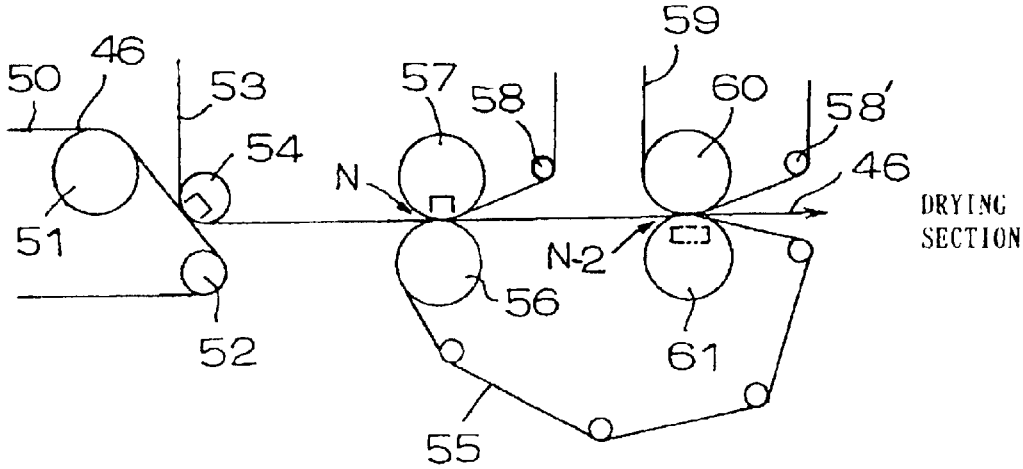
FIG. 5 is a diagrammatic view of a sheet transfer belt as used on a shoe press machine.

A sheet transfer belt 55 may be used as illustrated in FIG. 5. The sheet transfer belt exercises closed draw to enable high speed operation of the paper machine. A wet paper sheet 46 is formed on a forming wire belt 50. Between a couch roll 51 and a turning roll 52, the wet paper sheet 46 is separated from the forming wire belt 50 by a felt pickup belt 53 wound around a pickup roll 54 provided with suction glands. The wet paper sheet 46, adhering to the outer surface of the pickup felt belt 53, is conveyed to a press nip N between the pickup felt belt 53 and a sheet transfer belt 55. The pickup felt belt 53 is in contact with, and extends partway around, a top press roll 57, and the sheet transfer belt 55 is in contact with, and extends partway around, a bottom press roll 56.

When the wet paper sheet 46 is compressed in the press nip N, water is transferred from the wet paper sheet 46 to the felt pickup belt 53. After passing the press nip N, the felt pickup belt 53 is separated from the wet paper sheet 46 by a guide roll 58.

The wet paper sheet 46 is conveyed by the sheet transfer belt 55 toward a second press nip N-2. The sheet transfer belt 55 has a flat, smooth surface impermeable to water, and hence there is no rewetting of the wet paper sheet 46, which would occur if a felt belt were used.

The wet paper sheet 46 is squeezed again at the second press nip N-2 by a top press roll 60, a bottom press roll 61, a press felt belt 59 and a sheet transfer belt 55. A shoe and a press belt may be substituted for the bottom press roll 61. The sheet transfer belt 55 is separated from a wet paper sheet 46 by another guide roll 58' and the wet paper sheet 46 is delivered to a drying section.

During the foregoing process, the wet paper sheet 46 is carried by the sheet transfer belt 55 or a felt belt. These belts prevent the wet paper sheet from being broken, and hence the wet paper sheet 46 can be formed at a high speed.

In the open type shoe press paper machine (FIG. 4), a lubricating oil is sprayed by an oil spraying device 47 onto the inner surface of the shoe press belt 43 at a position immediately upstream of the shoe 42 to reduce friction between the inner surface of the shoe press belt 43 and the shoe 42. The lubricating oil sprayed onto the inner surface of the shoe press belt 43 is scraped off the shoe press belt 43 by a scraper 48 and an oil removing brush 49, both disposed downstream with respect to the location of the shoe 42.

Figure 7:
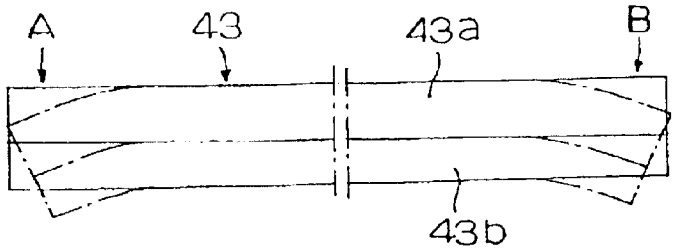
FIG. 7 (a) PRIOR ART
FIGS. 7(*a*), 7(*b*), 7(*c*) and 7(*d*) are partly omitted schematic cross-sectional views of a conventional inner-surface coated belt, a conventional outer-surface coated belt, a conventional outside-covered one-surface coated belt and a conventional inside-covered one-surface coated belt, respectively.
Figure 7B:
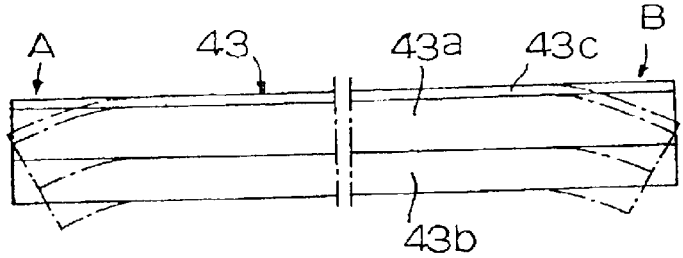
FIG. 7(b) PRIOR ART
Figure 7C:
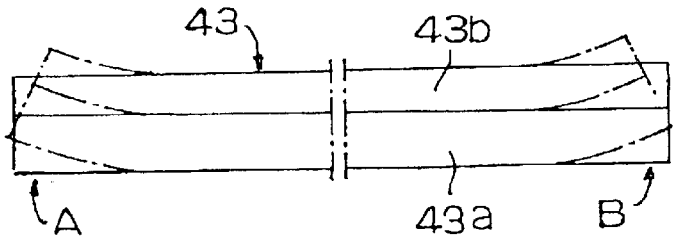
FIG. 7(c) PRIOR ART
Figure 7D:
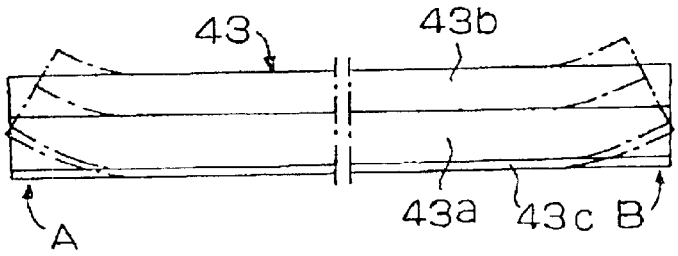
FIG. 7(d) PRIOR ART

As shown as FIG. 7(*a*), most papermaking belts formerly used on the open type shoe press paper machine (e.g. the shoe press belt 43) have a one-surface coated belt comprising a base layer 43*a* and a resin layer 43*b* coating the lower surface, i.e., the surface of the base layer 43*a* on the shoe-contacting side of the belt.

As shown in FIG. 7(*b*), outside-covered, one-surface coated belts recently introduced into the market have a base layer 43*a*, a resin layer 43*b* formed on the inner surface of the base layer 43*a*, and a thin resin layer 43*c* formed on the outer surface of the base layer 43*a*, i.e. the felt belt-contacting surface. The objective of this belt structure is to enhance abrasion resistance and draining performance.

Inside-covered, one-surface coated papermaking belts for achieving closed draw (e.g. sheet transfer belt 55) have also been recently introduced into the market. These belts have a construction opposite to that of the outside-covered, one-surface coated belt.

Single edged parts A and B of each of the one-surface coated belts, the outside-covered, one-surfaced coated belt and the inside-covered, one-surfaced coated belt have a tendency to curl toward the side of the resin layer on the side of the shoe as indicated by chain lines in FIGS. 7(*a*) and 7(*b*). The tendency to curl occurs while the belt is in use due to stress induced therein by the difference in heat shrinkage between the base layer and the resin layer during the manufacture of the belt. i.e., an effect analogous to the bimetal effect. On the other hand, a transfer belt having an outer surface which comes into direct contact with a wet paper sheet to convey the same has a tendency to curl toward the side of the resin layer as indicated by chain lines in FIGS. 7(*c*) and 7(*d*).

To form the resin layer, a liquid resin of a single-component type or a two-component type is applied to the base layer. The resin layer shrinks as it hardens. The shrinkage of a resin layer formed by a hot melt coating process is even greater than that of a resin layer formed by liquid resin, and therefore the side edge parts of a belt provided with a resin layer formed by a hot melt coating process curl greatly.

Figure 6:
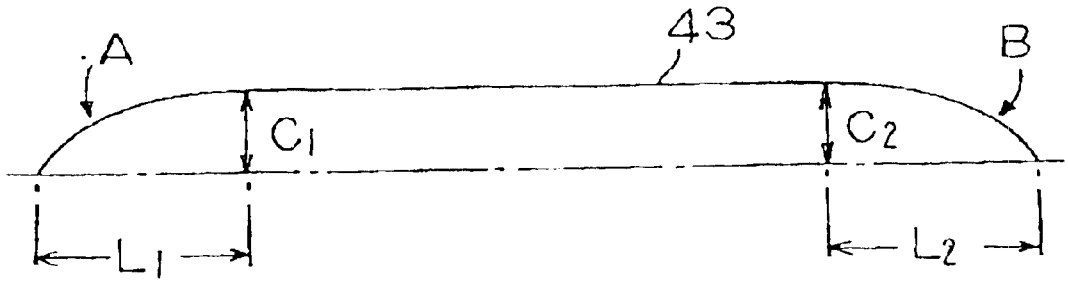
FIG. 6 is a diagram explaining the degree and length of curling of opposite side edge parts of an open type shoe press belt.
Figure 8:
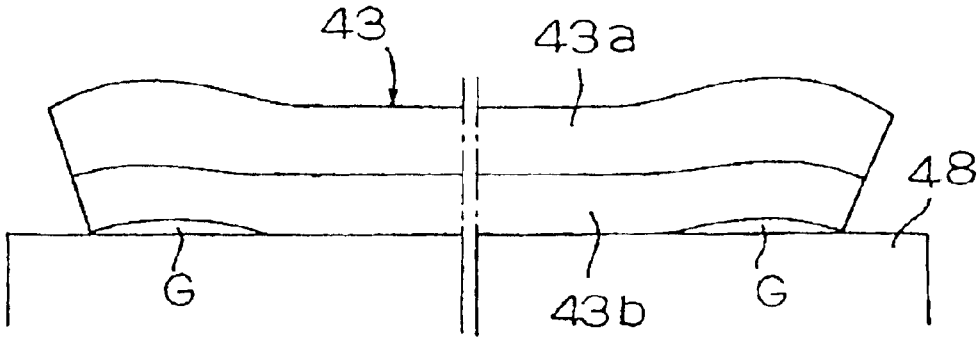
FIG. 8 PRIOR ART
FIG. 8 is a schematic view explaining the relation between a conventional belt and a scraper.

Although dependent on the combination of the base layer and the resin layer, the degree of curling in a belt, represented by values C1 and C2 in FIG. 6, is in the range of about 30 to about 100 mm in general. If the values C1 and C2 are 70 mm or greater, gaps G are formed between the scraper 48 and the inner surface of the belt as shown in FIG. 8. Therefore, the scraper 48 is unable to scrape the lubricating oil satisfactorily from the inner surface of the belt. It has been determined empirically that the widths L1 and L2 (FIG. 6) of curled side edge parts are about 100 mm.

As mentioned above, lubricating oil is scraped off the shoe press belt with a scraper 48. If the lubricating oil is not scraped off satisfactorily, the oil remaining on the inner surface of the belt is transferred from the belt to a roll R (FIG. 4) disposed below the scraper and the lubricating oil adhering to the roll R is scattered centrifugally as an oil mist around the paper machine as the roll R rotates. Consequently, the consumption of the lubricating oil increases, costs increase, equipment and the environment around the paper machine becomes soiled with lubricating oil, and waste water will also contain lubricating oil.

If the side edge portions of the belt are curled as indicated by chain lines in FIGS. 7(*a*), 7(*b*), 7(*c*) or 7(*d*), the contact of the side edges with guide palms becomes unstable, and this has an adverse effect on the turning of the belt. Moreover, the side edges of the belt tend to catch on the ends of the rolls when the belt is slipped onto the rolls, resulting in an increase in the time required to install the belt.

Preferred embodiments according to the invention will now be described with reference to FIGS. 1(*a*) to 3.

Referring to FIG. 1(*a*), a belt 1, of the one-surface coated type, comprises a base layer 2, and a resin layer 3 formed on the inner surface of the base layer 2, i.e., a surface of the base layer 2 on the shoe side of the belt. In the resin layer 3, opposite side edge parts A and B are thinner than the middle part C.

Referring to FIG. 1(*b*), a belt 1, of the outside-covered one-surface coated type, comprises a base layer 2, a thin resin layer 3 formed on the outer surface of the base layer 2, and a thick resin layer 3*b* formed on the inner surface of the base layer 2, i.e., a surface of the base layer 2 on the shoe side of the belt. In the thick resin layer 3*b*, opposite side edge parts A and B are thinner than the middle part C.

Referring to FIG. 1(*c*), a belt 1, of the one-surface coated type, comprises a base layer 2, a resin layer 3 formed on the outer surface of the base layer 2, i.e., a surface of the base layer 2 on the side of a felt belt. In the resin layer 3, opposite side edge parts A and B are thinner than the middle part C.

Referring to FIG. 1(*d*), a belt 1, of an inside-covered one-surface coated type, comprises a base layer 2, a thin resin layer 3*a* formed on the inner surface of the base layer 2, and a thick resin layer 3*b* formed on the outer surface of the base layer 2. Here again, in the thick resin layer 3*b*, opposite side edge parts A and B are thinner than the middle part C.

The base layer 2 is a double fabric of a 3/1–1/3 weave, provided with batting woven from, for example, 0.4 mm diameter polyester monofilament yarns as warp yarns and weft yarns, and having an intermediate layer of 3000 d polyester multifilament yarns.

The resin layer 3 of the one-surface coated belt, the inner thick resin layer 3*b* of the outside-covered, one-surface coated belt, and the outer thick resin layer 3*b* of the inside-covered, one-surface coated belt may be formed of a urethane resin. The opposite side edge parts A and B of the resin layer are thinner than the middle part C to suppress the curling of the side edge parts of the belt. Preferably, the opposite side edge parts of the resin layer are finished by grinding to form parts A and B in a thickness smaller than that of the middle part C. The opposite side edge parts A and B of the resin layer may, of course, be finished by any of various suitable alternative processes other than grinding.

In a first embodiment of the invention, a base layer was provided consisting of a 1.9 mm thick double fabric of a 3/1–1/3 weave provided with batting, woven from 0.4 mm diameter polyester monofilament yarns as warp yarns and weft yarns, and having an intermediate layer of 3000 d polyester multifilament yarns. The inner surface of the double fabric, i.e., the surface on the shoe side of the belt, was impregnated with a urethane resin to form a resin layer on the inner surface of the double fabric so that the thickness of a structure consisting of the double fabric and the resin layer was 3.5 mm. The urethane resin was set by heat, and the resin layer thus set was ground.

Figure 1A:
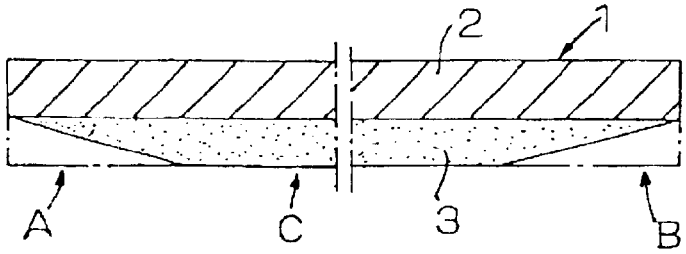
FIGS. 1(*a*), 1(*b*), 1(*c*) and 1(*d*) are partially omitted schematic cross-sectional views of an inner-surface coated belt, an outer-surface coated belt, an outside-covered one-surface coated belt and an inside-covered one-surfaced coated belt in accordance with the invention, respectively.
Figure 1B:
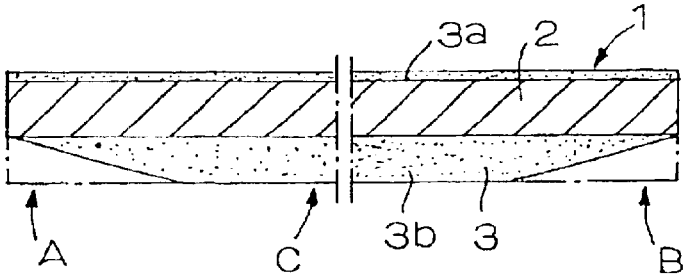
Figure 1C:
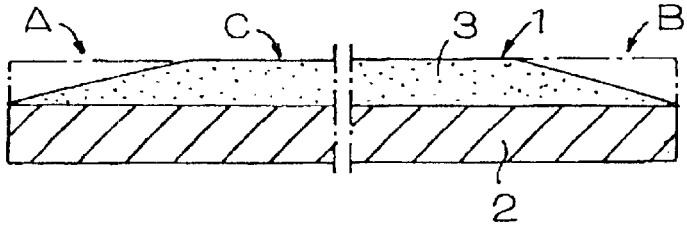
Figure 1D:
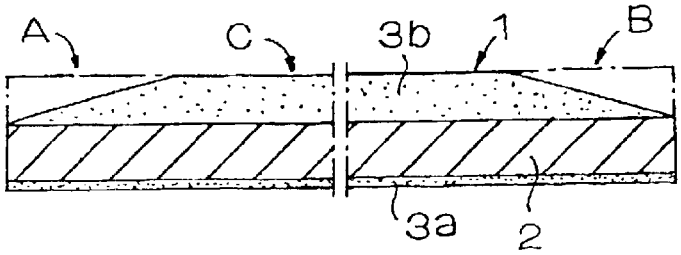
Figure 2A:
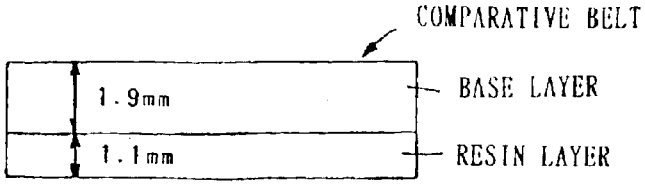
FIGS. 2(*a*), 2(*b*) and 2(*c*) are schematic, cross-sectional views of one side part of a belt in a first comparative example, a first working example and a second working example, respectively.
Figure 2B:
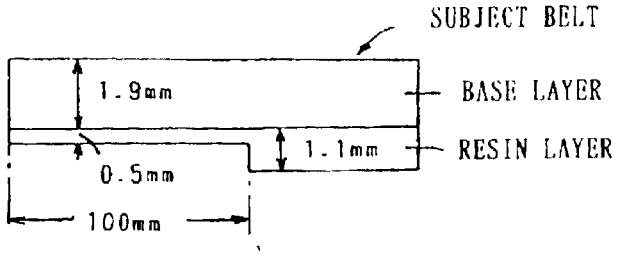
Figure 2C:
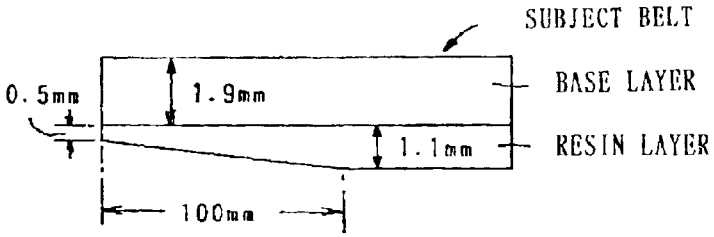

In FIG. 2(*a*), which shows a first comparative example, the resin layer was ground so that the total thickness of the structure consisting of the double fabric and the resin layer was 3.0 mm (the resin layer being 1.1 mm thick) to obtain a one-surface coated, shoe press belt. As shown in FIG. 2(*a*), the comparative shoe press belt was obtained by turning the one surface-coated belt inside out.

FIG. 2(*b*) illustrates a first working example of a belt in accordance with the invention. In FIG. 2(*b*), using a one-surface coated belt similar to the one-surface coated belt in the comparative example of FIG. 2(*a*), opposite side edge parts of the resin layer, 100 mm in width, were ground to a thickness of 0.5 mm, which is smaller by 0.6 mm than the thickness of the middle part of the resin layer. Here, as in FIG. 2(*a*), the shoe press belt was obtained by turning the one-surface coated belt inside out after grinding.

FIG. 2(*c*) illustrates a second working example of a belt in accordance with the invention. In FIG. 2(*c*), again using a one-surface coated belt similar to the one-surface coated belt in the comparative example of FIG. 2(*a*), each of the opposite side edge parts of the resin layer, 100 mm in width, was ground on a slope so that the thickness of the resin layer at the side edges was 0.5 mm and the thickness of the same at a position at 100 mm from the side edge was equal to that of the middle part of the resin layer. As in FIGS. 2(*a*) and 2(*b*), the shoe press belt was obtained by turning the one-surface coated belt inside out after grinding.

The degrees of curling (C1 and C2 illustrated in FIG. 6) of side edge parts of the one-surface coated belts in the first comparative example and the first and second working examples were measured. The degree of curling on both sides (C1 and C2) was 60 mm with the first comparative example, 10 mm with the first working example and 20 mm with the second working example. These measurements proved that the side edge parts of the one-surface coated belts of the invention have improved curling properties.

When the belts of the first and second working examples were used on a practical paper machine, no particular problems arose. There was a concern that the side edge parts of the one-surface coated belts might become separated from a scraper after passing a shoe and that the oil adhering to those parts might not be scraped off because the thickness of the resin layer in the side edge parts are reduced by grinding. However, no such problem occurred. Because the difference in thickness between the side edge parts and the middle part of the one-surface coated belts was as small as 0.6 mm (smaller in the one-surface coated belt of the second working example), oil could be scraped off the side edge parts satisfactorily, and oil remaining on the side edge parts could be removed by a brush disposed beyond the scraper in the running direction of the belt. Consequently, oil was not scattered and oil consumption was reduced greatly from 60 liters/day to 10 liters/day. The one-surface coated belts in the first and second working examples exhibited satisfactory belt turning performance, and loading the belts into the paper machine was facilitated because the opposite side edges were not curled.

In a second embodiment of the invention, a 2.8 mm thick base layer was formed by combining an outer layer of 0.4 mm diameter polyester monofilament yarns arranged widthwise, an intermediate layer of 0.4 mm diameter polyester monofilament yarns arranged longitudinally, and an inner layer of 6000 d multifilament polyester yarns arranged widthwise. A urethane resin was applied to one surface of the base layer so that the urethane resin infiltrated into the base layer to a depth of 0.2 mm. The base layer was impregnated with urethane resin, and a 1.5 mm thick resin layer was formed on the opposite surface of the base layer. The urethane resin that was applied to the base layer was hardened by heat, and the resin layer was ground to produce a 4.0 mm thick, belt. After grinding, the belt was turned inside-out to produce the outside-covered, one-surface coated shoe press belt, shown in FIG. 3(*a*) as a second comparative example.

Figure 3A:
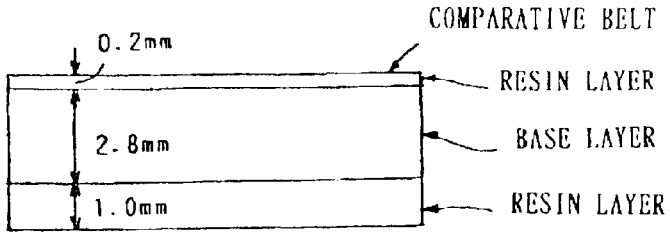
FIGS. 3(*a*), 3(*b*) and 3(*c*) are schematic, cross-sectional views of one side part of a belt in a second comparative example a third working example and a fourth working example, respectively.
Figure 3B:
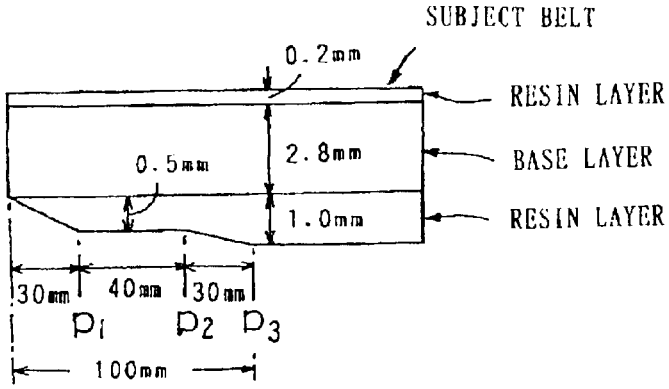
Figure 3C:
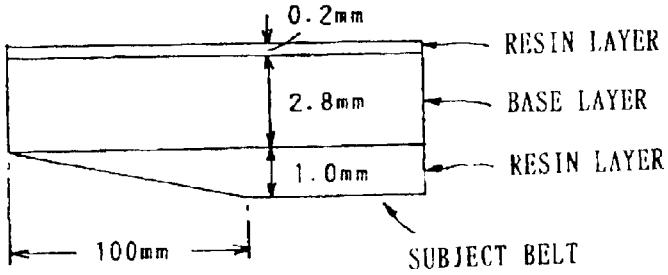

In the third working example, illustrated in FIG. 3(*b*), starting with a belt corresponding to that of the second comparative example in FIG. 3(*a*), each of two opposite side edge parts, 100 mm in width, was ground so that the thickness of the resin layer at the side edge is zero mm, the resin layer is inclined from the side edge to a line p1 at a distance of 30 mm from the edge, the resin layer is horizontal, with a thickness of 0.5 mm, between the line p1 and a line p2 at a distance of 40 mm from the line p1, the resin layer is inclined from the line p2 to a line p3 at a distance of 30 mm from the line p2, and the thickness of the resin layer on the line p3 is equal to the thickness of the middle part of the resin layer. FIG. 3(*b*) shows a shoe press belt obtained by turning the belt inside out after grinding.

In the fourth working example, illustrated in FIG. 3(*c*), again starting with a belt corresponding to that of the second comparative example in FIG. 3(*a*), each of two opposite side edge parts, 100 mm in width, of the resin layer was ground on a slope so that the thickness of the resin layer at the side edge was zero mm and the thickness of the same at a position 100 mm from the side edge was equal to that of a middle part. FIG. 3(*c*) shows the shoe press belt obtained by turning the belt inside-out after grinding.

The degrees of curling (C1 and C2 in FIG. 6) of the belts in the second comparative example and the third and fourth working examples were measured. The degree of curling of the belt of the second comparative example (FIG. 3(*a*)) was 55 mm, the degree of curling of the belt in the third working example (FIG. 3(*b*)) was 10 mm, and the degree of curling of the belt in the fourth working example (FIG. 3(*c*)) was 20 mm. These measurements also proved that the side edge parts of the belts of the invention had greatly improved curling properties.

The belts in the third and fourth working examples were subjected to tests on a practical paper machine. No particular problems occurred. There was a concern that the side edge parts of the belts in might be separated from a scraper after passing a shoe and that the oil adhering to those parts might not be scraped off because the opposite side edge parts of the belts are finished by grinding. However, no such problem was observed because the difference in thickness between the side edge parts and the middle part of the belts was small. The oil could be scraped off the side edge parts of the belts satisfactorily by the scraper, and the oil remaining on the side edge parts could be removed by a brush disposed beyond the scraper in the running direction of the belts. Consequently, oil was not scattered, and oil consumption was reduced greatly from 60 liters/day to 10 liters/day. The belts in the third and fourth working examples performed satisfactorily in turning could be loaded into the paper machine readily because the opposite side edge parts of the same were not curled.

Although belts provided with the thick resin layer formed on the inner surface of the base layer have been described, it has been determined that belts provided each with a thick resin layer on the outside surface of the base layer exhibit the same properties.

As is apparent from the foregoing description, according to the invention, each belt, whether it be for use as an open type shoe press belt or as a sheet transfer belt, comprises a base layer and a resin layer overlying or underlying the base layer when the belt is mounted on a paper machine. The resin layer is formed so that the thickness of its opposite side edge parts is smaller than that of its middle part, the terms "side" and "middle" referring to positions separated from one another in the widthwise direction, i.e. a direction parallel to the upper and lower faces of the belt and perpendicular to its running direction. The provision of side edge parts having a thickness less than that of the middle part suppresses the differential shrinkage or contraction analogous to the "bimetal" effect, intrinsic to one-surface coated belts. Consequently, the curling of the opposite side edge parts of the belt can be reduced greatly.

In the case of an outside-covered, one-surface coated papermaking belt or the inside-covered one-surface coated papermaking belt, such as an open type shoe press belt or a sheet transfer belt, the belt comprises a base layer, a thin resin layer formed on one of the surfaces of the base layer when the papermaking belt is mounted on a paper machine, and a thick resin layer formed on the other surface of the base layer. The thick resin layer is formed so that the thickness of the opposite side edge parts thereof is smaller than that of the middle part. Therefore, the differential shrinkage phenomenon is also greatly reduced in this type of belt and difficulties caused by curling of the opposite side edge parts of the belts can be avoided.

Accordingly, no significant gap is formed between the oil scraper and the opposite side edges of the belt, whether it be a simple one-surface coated belt, an inside-covered one-surface coated belt or an outside-covered one-surface coated belt. Oil adhering to the belt can be scraped off satisfactorily, the oil is not scattered, and the consumption of oil is greatly reduced. The one-surface coated belt comprising a base layer and a resin layer coating the outer or the inner surface of the base layer, the outside-covered, one-surface coated belt, and the inside-covered, one-surface coated belt in accordance with the invention are also satisfactory in turning performance and readily loaded into a paper machine.

What is claimed is:

1. A papermaking machine having at least one belt for transporting a paper sheet along a path in the machine wherein the paper sheet is in parallel, juxtaposed relation to a surface of the belt, the belt comprising a base layer and a resin layer, wherein all of said resin layer either overlies or underlies the base layer at any location along said path when the papermaking belt is mounted on a papermaking machine, the resin layer having a middle part and opposite side edge parts, wherein the thickness of the opposite side edge parts of the resin layer is smaller than that of the middle part thereof, whereby curling of side edges of the belt is prevented by suppressing differential thermal contraction between the base layer and the resin layer.

2. A papermaking machine according to claim 1, wherein said belt is a belt from the group consisting of shoe press belts and transfer belts.

3. A papermaking machine according to claim 1, in which the papermaking machine includes rollers having cylindrical surfaces over which the belt travels, and in which the belt has opposite parallel surfaces, one of which contacts the cylindrical surfaces of the rollers over its entire width.

4. A papermaking machine according to claim 1, comprising a nip, said nip being composed of a first element located in opposed relationship to said surface of the belt, and a second element in opposed relationship to said first element, the belt being movable between said elements, and said elements being sufficiently close to each other to apply pressure to a paper sheet on said belt.

5. A papermaking machine having at least one belt for transporting a paper sheet along a path in the machine wherein the paper sheet is in parallel, juxtaposed relation to a surface of the belt, the belt comprising a base layer having opposite surfaces, a thin resin layer formed on one of the surfaces of the base layer and a thick resin layer formed on the other surface of the base layer, wherein all of said thick resin layer either overlies or underlies the base layer at any location alone said path, the thick resin layer has a middle part and opposite side edge parts, and the thickness of the opposite side edge parts of the thick resin layer is smaller than that of the middle part thereof, whereby curling of side edges of the belt is prevented by suppressing differential thermal contraction between the base layer and the thick resin layer.

6. A papermaking machine according to claim 5, wherein said belt is a belt from the group consisting of shoe press belts and transfer belts.

7. A papermaking machine according to claim 5, in which the papermaking machine includes rollers having cylindrical surfaces over which the belt travels, and in which the belt has opposite parallel surfaces, one of which contacts the cylindrical surfaces of the rollers over its entire width.

8. A papermaking machine according to claim 5, comprising a nip, said nip being composed of a first element located in opposed relationship to said surface of the belt, and a second element in opposed relationship to said first element, the belt being movable between said elements, and said elements being sufficiently close to each other to apply pressure to a paper sheet on said belt.

* * * * *